US007383006B2

(12) United States Patent
Matsuura

(10) Patent No.: US 7,383,006 B2
(45) Date of Patent: Jun. 3, 2008

(54) IMAGE FORMING APPARATUS

(75) Inventor: Taisuke Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/216,005

(22) Filed: Sep. 1, 2005

(65) Prior Publication Data

US 2006/0045580 A1 Mar. 2, 2006

(30) Foreign Application Priority Data

Sep. 2, 2004 (JP) ..... 2004-255272

(51) Int. Cl.
*G03G 15/16* (2006.01)

(52) U.S. Cl. ..... 399/316; 399/313; 399/317

(58) Field of Classification Search ..... 399/313, 399/316, 317, 388
See application file for complete search history.

(56) References Cited

U.S. PATENT DOCUMENTS 4,338,017 A * 7/1982 Nishikawa ..... 399/313
5,189,469 A * 2/1993 Endo
5,923,921 A * 7/1999 OuYang et al. ..... 399/317
6,055,409 A * 4/2000 Richards et al. ..... 399/388
6,493,534 B2 * 12/2002 Sawanaka et al. ..... 399/316
6,983,121 B2 * 1/2006 Sawai ..... 399/388
2005/0025536 A1 * 2/2005 Gross et al. ..... 399/316

FOREIGN PATENT DOCUMENTS

JP 9-127804 5/1997

* cited by examiner

*Primary Examiner*—Susan S Lee
(74) *Attorney, Agent, or Firm*—Fitzpatrick, Cella, Harper & Scinto

(57) ABSTRACT

An image forming apparatus including a transfer member urging unit that urges a transfer member to an image bearing drum at a line pressure of $18.62\times10^{-3}$ N/mm or less and $2.47\times10^{-3}$ N/mm or more, the line pressure being taken along a direction perpendicular to a recording material conveying direction.

2 Claims, 6 Drawing Sheets

$$P_1\beta = 0.14\,(N) < Pg < P_1\alpha = 2.99\,(N)$$

* WHEN LOWER TRANSFER GUIDE IS FIXED

IMAGE FORMING APPARATUS

BACKGROUND OF THE INVENTION

1. Field of the Invention

The present invention relates to an electrophotographic type image forming apparatus, more specifically relates to an image forming apparatus having transfer means contacting to an image bearing member through a low pressure, for electrostatically transferring a toner image adhered on the image bearing member to a recording material at a transfer region, and a guide member for restricting a conveying path of conveying the recording material to the transfer region.

2. Description of the Related Art

The electrophotographic type image forming apparatus electrically charges an image bearing drum in a uniform manner and then exposes it to form an electrostatic latent image, forms a toner image by development, transfers the toner image to a recording material, thermally fixes the toner image by fixed means, and then outputs the image-fixed recording material as an image-formed article (copy, print).

In these days, there have been used many transfer materials contacting the image bearing drum, as transfer materials for transferring the toner image from the image bearing drum to the recording material. There is an advantage that the transfer member contacting the image bearing drum reduces a bias voltage which is applied to the transfer member during the transfer.

A description will now be made of a conventional image forming apparatus.

FIG. 6 shows a conveying path of a transfer material Q between a guide member 3 and a transfer region in which a toner image on an image bearing drum 1 is transferred on to the recording material Q by a transfer member 5, in a conventional image forming apparatus.

As shown in FIG. 6, there are around the image bearing drum 1 an electrically charging roller 8 and a development roller 9. The recording material Q is nipped at a region (first contact region) where the transfer member 5 and the image bearing drum 1 contact each other. Applying a bias to the transfer member 5 from an electric source 17 causes the toner image to be transferred on to the recording material Q. The transfer member 5 is pressed to the image bearing drum 1 by a transfer member urging member 6. At a location upstream of the first contact region in a recording material-conveying direction, registration roller pair 2 are arranged, and a guide member 3 is arranged between the registration roller pair 2 and the transfer region.

The recording material Q contacts the guide member 3 at a second contact region, and then enters into the first contact region; accordingly, a positional relationship of the guide member 3 and the transfer region leads to definition of an angle of the transfer material Q entering into the transfer member 5.

When the recording material Q is conveyed to the first contact region along the transfer member 5, the toner image on the image bearing drum 1 is subjected to unfavorable transfer to thereby provide the image dispersion, before the recording material 5 enters into the first contact region under the influence of an electric field formed between the bias-applied transfer member 5 and the image bearing drum 1. In order to prevent the toner image-dispersion immediately before the first contact region (so-called pre-transfer phenomenon), it is so constructed that a tip of the guide member 3 is arranged on a side of the image bearing drum 1 with respect to a tangent line R of the image bearing drum 1 at a recording material conveying direction-wise center of the first contact region, and then the transfer material Q enters into the first contact region along the image bearing drum 1.

On the other hand, a surface of the image bearing drum 1 gets more scarred or scratched as the number of prints increases. When the image bearing drum 1 gets scarred or scratched over a predetermined amount, uneven electrical charge and so on causes an abnormal image to be formed on the print. Usually the life of the image bearing drum 1 is set to the printing-possible number of sheets in which the electrical charge-abnormal does not occur, and hence a long life image bearing drum which is capable of carrying out printing much more is desired in order to reduce the running cost. Therefore, an image forming apparatus using the transfer member 5 may be so constructed that the pressing force of the transfer member 5 pressing the image bearing drum 1 is reduced in order to prevent the image bearing drum 1 from getting scarred and scratched due to the transfer member 5 pressing the photosensitive drum 1 (Japanese Patent Application Laid-open No. 9-127804)

Moreover, when the pressing force is too weak, the photosensitive drum 1 easily has a shock due to a change of a sheet stance during the sheet conveying, thereby possibly providing poor images. Therefore, it is required to increase the pressing force of the transfer member 5 pressing the photosensitive drum 1 over a predetermined value in order to stably convey a paper.

However, in the above-mentioned image forming apparatus in which the pressing force of the transfer member 5 pressing the image bearing drum 1 is reduced, when using a high rigid heavy paper as the recording paper Q, the pressing force of the recording material going down the transfer member is superior to the pressing force of the transfer member 5 pressing the image bearing drum 1 due to the principle of leverage, thereby causing the transfer member 5 to separate from the image bearing drum 1, which provides the poor transfer. The poor transfer occurring by the transfer member 5 separating from the image bearing drum 1 causes the image appearance quality to be more damaged, compared with the poor image due to the pre-transfer phenomenon. Accordingly, when using a high rigid heavy paper as the recording material Q, it is more important to prevent the poor transfer occurring by the transfer member separating from the image bearing drum, compared with the poor image due to the pre-transfer phenomenon.

Here, there occurs a problem that it is difficult to prevent the transfer member from separating from the image bearing drum when using a high rigid recording material such as a heavy paper, and simultaneously reduce the occurrence of the pre-transfer phenomenon when using a low rigid recording material such as a thin paper.

SUMMARY OF THE INVENTION

It is, therefore, an object of the present invention to provide an image forming apparatus using a transfer member contacting an image bearing drum through a low pressing force, which is capable of preventing the transfer member 4 from separating from the image bearing drum 1 when using a high rigid recording material such as a heavy paper, and simultaneously reducing the occurrence of the pre-transfer phenomenon when using low rigid recording material such as a thin paper.

Also, it is another object of the invention to provide the following image forming apparatus.

The image forming apparatus includes an image bearing drum that bears a toner image, a transfer member that contacts the image bearing drum at a first contact region, and electrostatically transfers the toner image on to a recording material being conveyed, a transfer member urging unit that urges the transfer member to the image bearing drum at a line pressure of $18.62\times10^{-3}$ N/mm or less and $2.47\times10^{-3}$ N/mm or more, the line pressure being taken along a direction perpendicular to a recording material conveying direction, a guide member that contacts a rear side surface opposite to a toner-transferred-side surface of the recording material, that is movable in a direction substantially perpendicular to a tangent line of the image bearing drum at a recording material conveying direction-wise center of the first contact region and toward the recording material, and that guides the recording material being conveyed toward the first contact region, a guide member urging unit that urges the guide member toward the recording material contacting the guide member along a moving direction of the guide member, wherein when respective symbols are defined as follows:

$I\alpha(m^4)$: a second moment of cross-section of the recording material which is the greatest in basic weight and the longest in a direction perpendicular to the recording material conveying direction, out of the recording materials which are capable of being image-formed, $E\alpha(N/m^2)$: Young's modulus, $I\beta(m^4)$: a second moment of cross-section of the recording material which is greatest in basic weight and the longest in a direction perpendicular to the recording material conveying direction, out of the recording materials which are capable of being image-formed, v1(m): a distance from a recording material conveying direction-wise center of the second contact region to the tangent line of the image bearing drum in a state where the recording material does not contact the guide member, and a1(m): a distance from a foot of a perpendicular line drawn from a recording material conveying direction-wise center of the second contact region drawn to the tangent line of the image bearing drum, to the most upstream side location of the first contact region in the recording material conveying direction, in a state where the recording material does not contact the guide member, $P1\alpha(N)$: a substantially perpendicular component part to the tangent line of the image bearing drum, out of a force of the recording material pressing a recording material conveying direction-wise center of the second contact region, in which the recording material is the greatest in basic weight out of the recording materials which are capable of being image-formed and the longest in a direction perpendicular to the recording material conveying direction, $P1\beta(N)$: a substantially perpendicular component part to the tangent line of the image bearing drum, out of a force of the recording material pressing a recording material conveying direction-wise center of the second contact region, in which the recording material is the least in basic weight and the longest in a direction perpendicular to the recording material conveying direction, out of the recording materials which are capable of being image-formed, and Pg(N): a substantially perpendicular component part to the tangent line of the image bearing drum, out of a pressing force of the guide member urging unit pressing the guide member, $$P1\beta<Pg<P1\alpha$$

where $P1\alpha=3v1E\alpha I\alpha/a1^3$, $$P1\beta=3v1E\beta I\beta/a1^3$$

holds.

Further, it is still another object of the invention to provide an image forming apparatus including:

an image bearing belt that bears a toner image;

a support roller that contacts a rear side surface opposite to a toner-bearing-side surface of the image bearing belt, and supports the image bearing belt;

a transfer member that contacts the toner-bearing-side surface of the image bearing belt at a first contact region supported by the support roller, and electrostatically transfers the toner image on to a recording material being conveyed;

a transfer member urging unit that urges the transfer member to the image bearing belt at a line pressure of $18.62\times10^{-3}$ N/mm or less and $2.47\times10^{-3}$ N/mm or more, the line pressure being taken along a direction perpendicular to a recording material conveying direction;

a guide member that contacts a rear side surface opposite to a toner-transferred-side surface of the recording material, that is movable in a direction substantially perpendicular to a tangent line of the image bearing belt at a recording material conveying direction-wise center of the first contact region and toward the recording material, and that guides the recording material being conveyed toward the first contact region;

a guide member urging unit that urges the guide member toward the recording material contacting the guide member along a moving direction of the guide member, wherein when respective symbols are defined as follows:

$I\alpha(m^4)$: a second moment of cross-section of the recording material which is the greatest in basic weight and the longest in a direction perpendicular to the recording material conveying direction, out of the recording materials which are capable of being image-formed, $E\alpha(N/m^2)$: Young's modulus, $I\beta(m^4)$: a second moment of cross-section of the recording material which is the greatest in basic weight and the longest in a direction perpendicular to the recording material conveying direction, out of the recording materials which are capable of being image-formed, v1(m): a distance from a recording material conveying direction-wise center of the second contact region to the tangent line of the image bearing belt in a state where the recording material does not contact the guide member, and a1(m): a distance from a foot of a perpendicular line drawn from a recording material conveying direction-wise center of the second contact region drawn to the tangent line of the image bearing belt, to the most upstream side location of the first contact region in the recording material conveying direction, in a state where the recording material does not contact the guide member, $P1\alpha(N)$: a substantially perpendicular component part to the tangent line of the image bearing belt, out of a force of the recording material pressing a recording material conveying direction-wise center of the second contact region, in which the recording material is the greatest in basic weight and the longest in a direction perpendicular to the recording material conveying direction, out of the recording materials which are capable of being image-formed, $P1\beta(N)$: a substantially perpendicular component part to the tangent line of the image bearing belt, out of a force of the recording material pressing a recording material conveying direction-wise center of the second contact region, in which the recording material is the least and the longest in a direction perpendicular to the recording material conveying direction, out of the recording materials which are capable of being image-formed and Pg(N): a substantially perpendicular component part to the tangent line of the image bearing belt, out of a pressing force of the guide member urging unit pressing the guide member, $$P1\beta<Pg<P1\alpha$$

where $P1\alpha=3v1E\alpha I\alpha/a1^3$, $$P1\beta=3v1E\beta I\beta/a1^3$$

holds.

DESCRIPTION OF THE PREFERRED EMBODIMENT

Figure 1:
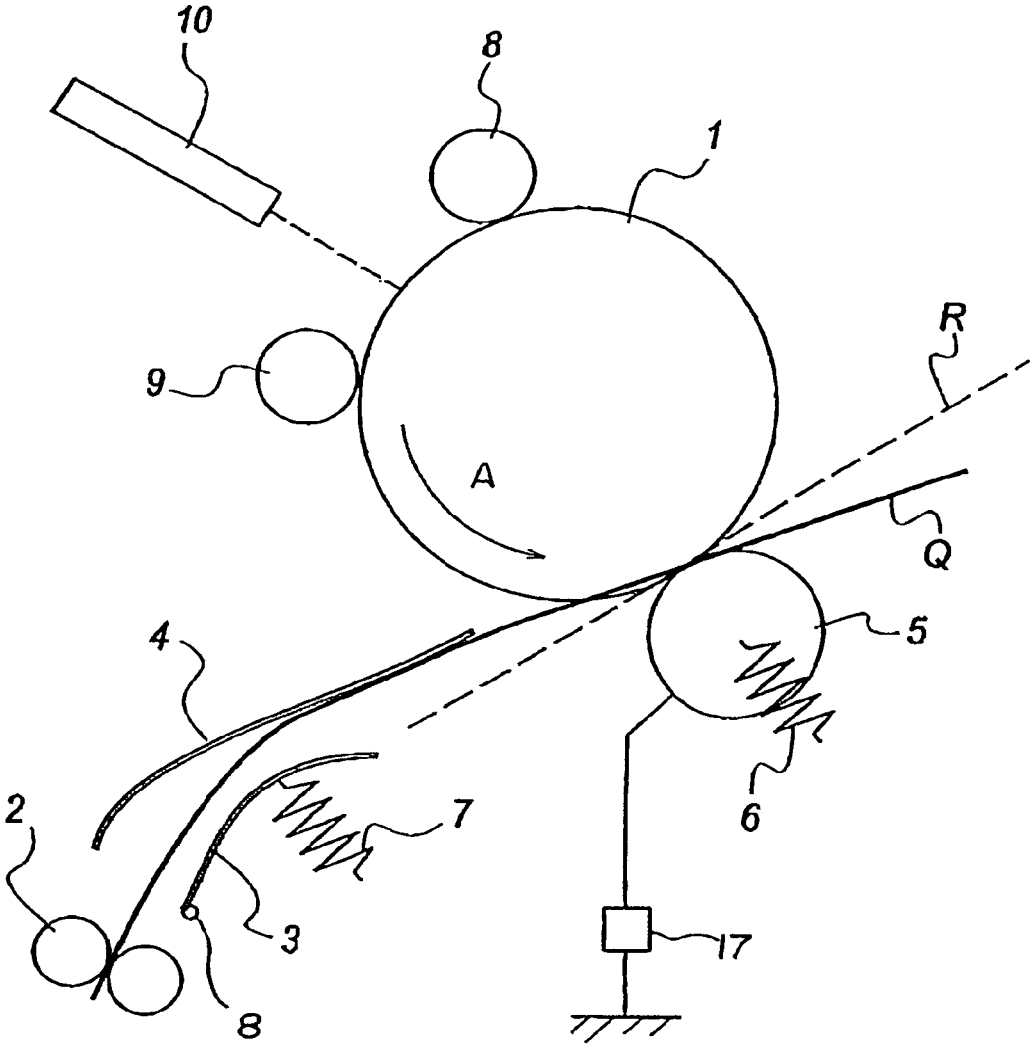
FIG. 1 schematically shows an arrangement of essential parts of an image forming apparatus according to a first embodiment of the invention.

According to the invention, there is provided an image forming apparatus including:

a guide member that contacts a rear side surface opposite to a toner-transferred-side surface of a recording material, that is movable in a direction substantially perpendicular to a tangent line of the image bearing drum (or an image bearing belt) at a recording material conveying direction-wise center of a first contact region and toward the recording material, and that guides the recording material being conveyed toward the first contact region;

a guide member urging unit that urges the guide member toward the recording material contacting the guide member along a moving direction of the guide member, wherein when respective symbols are defined as follows:

$I\alpha(m^4)$: a second moment of cross-section of the recording material which is the greatest in basic weight and the longest in a direction perpendicular to the recording material conveying direction, out of the recording materials which are capable of being image-formed, $E\alpha(N/m^2)$: Young's modulus, $I\beta(m^4)$: a second moment of cross-section of the recording material which is the least in basic weight and the longest in a direction perpendicular to the recording material conveying direction, out of the recording materials which are capable of being image-formed, v1(m): a distance from a recording material conveying direction-wise center of the second contact region to the tangent line of the image bearing drum (or the image bearing belt) in a state where the recording material does not contact the guide member, and a1(m): a distance from a foot of a perpendicular line drawn from a recording material conveying direction-wise center of the second contact region drawn to the tangent line of the image bearing drum (or the image bearing belt), to the most upstream side location of the first contact region in the recording material conveying direction, in a state where the recording material does not contact the guide member, $P1\alpha(N)$: a substantially perpendicular component part to the tangent line of the image bearing drum (or the image bearing belt), out of a force of the recording material pressing a recording material conveying direction-wise center of the second contact region, in which the recording material is the greatest in basic weight out of the recording materials which are capable of being image-formed and the longest in a direction perpendicular to the recording material conveying direction, $P1\beta(N)$: a substantially perpendicular component part to the tangent line of the image bearing drum (or the image bearing belt), out of a force of the recording material pressing a recording material conveying direction-wise center of the second contact region, in which the recording material is the least and the longest in a direction perpendicular to the recording material conveying direction, out of the recording materials which are capable of being image-formed, and Pg(N): a substantially perpendicular component part to the tangent line of the image bearing drum (or the image bearing belt), out of a pressing force of the guide member urging unit pressing the guide member, $$P1\beta<Pg<P1\alpha$$

where $P1\alpha=3v1E\alpha I\alpha/a1^3$, $$P1\beta=3v1E\beta I\beta/a1^3$$

holds.

According to the above-mentioned construction, it is possible to prevent the transfer member from separating from the image bearing drum when using a high rigid recording material such as a heavy paper, and simultaneously reduce the occurrence of the so-called pre-transfer phenomenon when using low rigid recording material such as a thin paper.

That is, in a case where there is used a recording material which is the thickest and the longest in a direction perpendicular to the recording material conveying direction, out of the recording materials which are capable of being image-formed, and the pressing force of the recording material going down the transfer member attains a maximum due to the principle of leverage, the guide member moves in a direction of the tangent line of the image bearing drum (or the image bearing belt). This reduces the pressing force of the recording material going down the transfer member, thereby controlling the occurrence of the phenomenon of the transfer member separating from the image bearing drum (or the image bearing belt).

On the other hand, in a case where there is used a recording material which is the thinnest and the longest in a direction perpendicular to the recording material conveying direction, out of the recording materials which are capable of being image-formed, the guide member hardly moves, thereby enabling the recording material to be conveyed to the contact region between the image bearing drum (or the image bearing belt) and the transfer member without giving rise to the pre-transfer phenomenon.

The present invention will now be described in detail with reference to the accompanying drawings showing preferred embodiments thereof.

First Embodiment

Figure 2:
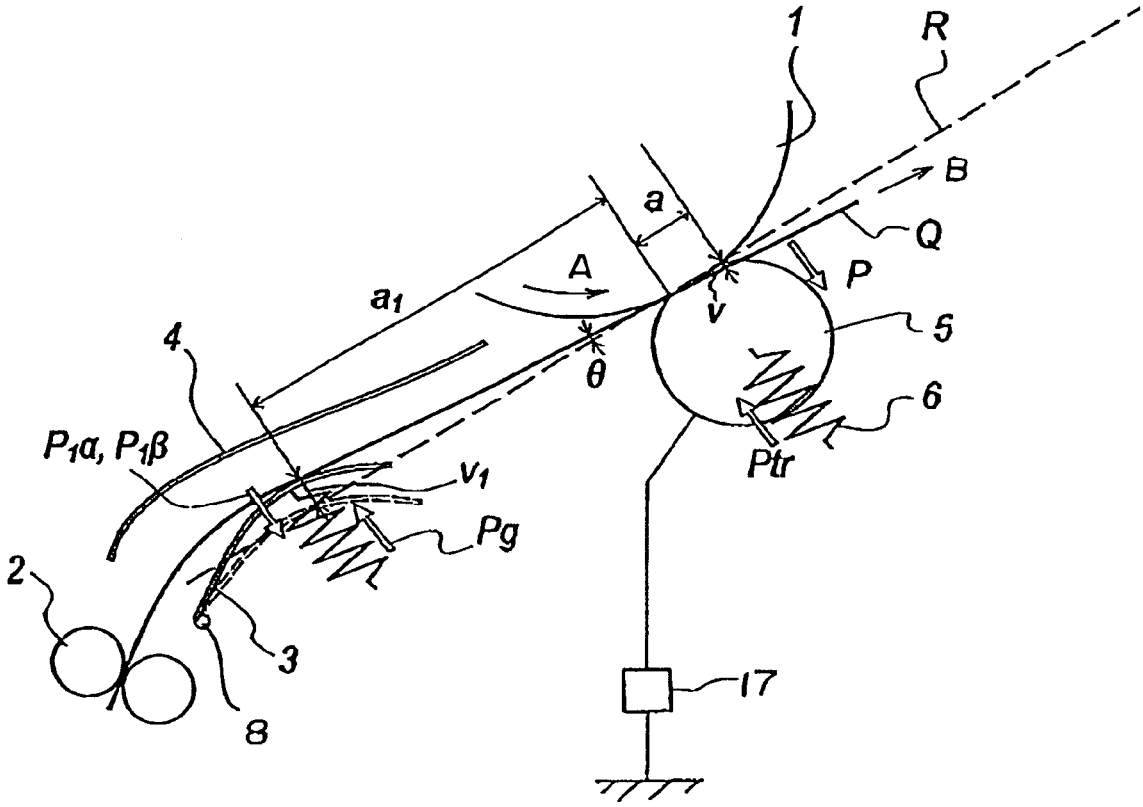
FIG. 2 is an enlarged diagrammatical view which is helpful in explaining around the transfer portion.

Referring first to FIGS. 1 and 2, there is described an image forming apparatus according to a first embodiment of the invention.

Figure 3:
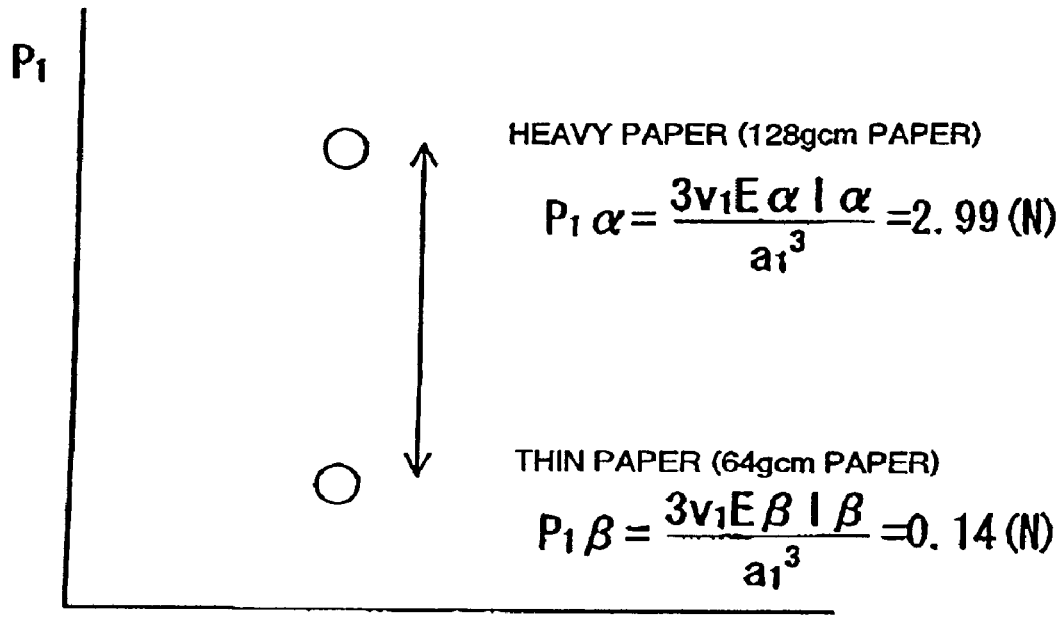
FIG. 3 is a view which is helpful in explaining pressures placed on a lower transfer guide.
Figure 6:
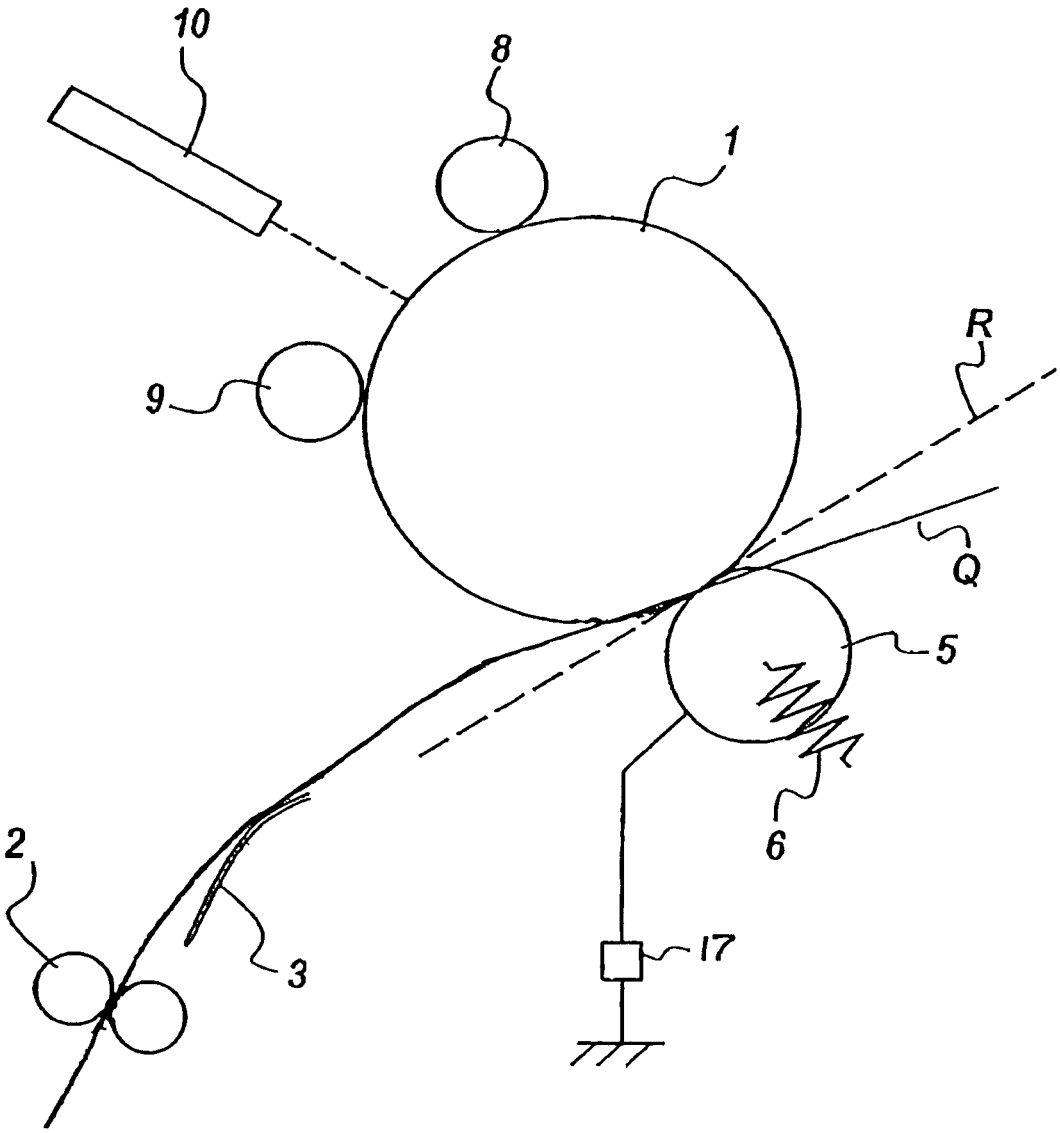
FIG. 6 schematically shows an arrangement of essential parts of an image forming apparatus according to a conventional example.

FIG. 1 schematically shows an arrangement of essential parts of an image forming apparatus according to a first embodiment of the invention, though substantially similar to FIG. 6. FIG. 2 is an enlarged diagrammatical view which is helpful in explaining a transfer portion and its vicinity, and FIG. 3 is a view which is helpful in explaining pressures placed on a lower transfer guide.

As shown in FIG. 1, there are disposed a charge roller 8 and a development roller 9 around a photosensitive member drum 1 (image bearing drum). A transfer roller 5 (transfer member) aims to nip and convey a recording material Q while transferring a toner image onto the conveyed recording material Q, and then is pressed to the photosensitive member drum 1 due to a roller pressing spring 6 (transfer member urging means). At a location upstream of a transfer portion (first contact region), which is a nip portion between the photosensitive member drum 1 and the transfer roller 5, registration roller pair 2 (transfer member conveying means) are disposed. Between the registration roller pair 2 and the transfer portion a lower transfer guide 3 (guide member) and an upper transfer guide 4 are disposed. The registration roller pair 2 convey the recording material Q to the transfer portion through the lower transfer guide 3 and the upper transfer guide 4.

The upper transfer roller 3 is movable so as to separate from or come close to the lower transfer roller 4, thereby making it possible to vary an angle of the transfer material Q entering into the nip portion between the photosensitive member drum 1 and the transfer roller 5. The lower transfer roller 3 is mounted swingably about a shaft 8 disposed at its one end, and then urged to a defining section (not shown) by a guide pressing spring 7 (guide member urging means) to thereby be normally positioned at a rest location. The lower transfer guide 3 swings with the shaft 8 as a center when the recording material Q contacts the lower transfer guide 3.

However, in this embodiment, when a tangent line of the photosensitive member drum 1 at a center of the nip portion between the photosensitive member drum 1 and the transfer roller 5 with respect to a conveying direction of the recording material Q is designated by R, it is possible to make a moving direction of the lower transfer guide 3 substantially perpendicular to the tangent line R because a moving distance of the lower transfer guide 3 is very short when the recording material Q contacts the lower transfer guide 3. "Substantially perpendicular" means falling within a range of ±10° with respect to a vertical line to the tangent line R. Further, the lower transfer guide 3 is movable toward the recording material from the tangent line R.

The photosensitive member drum 1 is rotatably driven at a predetermined circumferential velocity (process speed) in the direction of an arrow A. Applying a voltage of a DC bias and an AC bias superimposed to each other causes the charging roller 8 to charge a surface of the photosensitive member drum 1 to a predetermined polarity and a predetermined electric potential (primary charge). An exposure device 10 is a laser beam scanner, and outputs a laser light which is on/off-modulated corresponding to an image information inputted from an external device such as an image scanner and a computer, or the like, (not shown), to thereby scan and expose a charge-processed surface of the photosensitive member drum 1. This scan-exposure allows an electrostatic latent image to be formed on the surface of the photosensitive member drum 1. Then, the development unit supplies a developer (toner) onto the surface of the photosensitive member drum 1 through the development roller 9, thereby causing the electrostatic latent image to be visualized as a toner image. An electrophotographic type image forming apparatus such as a laser beam printer generally allows an inversion development method of adhering toner onto the exposure portion to carry out the development.

Based on a positional relationship among the registration roller pair 2, the upper transfer guide 4, and the transfer portion, a position of the upper transfer guide 4 leads to definition of a point where a tip of the recording material Q runs into the transfer portion. But, after the recording material Q reaches the transfer portion, the recording material Q runs along the lower transfer guide 3 located on a side of the photosensitive member drum 1 with respect to the tangent line R. Accordingly, a positional relationship between the lower transfer guide 3 and the transfer portion causes an angle of the recording material Q to be defined.

The recording material Q introduced to the transfer portion is nipped and conveyed by the photosensitive member drum 1 and the transfer roller 5, while the transfer roller 5 is supplied with a bias (transfer bias) of a controlled value from a transfer bias-supplying electric source (electric source) 17. The transfer roller 5 is supplied with the transfer bias which is reverse in polarity to the toner; therefore, the toner image on the photosensitive member drum 1 is electrostatically transferred onto a surface of the recording material. The recording material which has been subjected to transfer of the toner image at the transfer portion is separately conveyed from the photosensitive member drum 1, and then introduced to a fixing device (not shown) to be subjected to a fixing process.

Next, a description will be given of the transfer portion and its vicinity with reference to FIGS. 1 and 2.

In this embodiment, it is desirable that the pressing force of the roller pressing spring 6 pressing the transfer roller 5 to the photosensitive member drum 1 has a lower limit of $18.62\times10^{-3}$ N/mm or less in a sheet width direction-wise line pressure to the photosensitive member drum 1, in order to prevent the photosensitive member drum 1 from getting scarred or scratched due to the pressing of the transfer roller 5. Also, it is desirable that the lower limit is $2.47\times10^{-3}$ N/mm or more, taking account of the stability of the recording material. In this embodiment, the actual pressure is set to a light pressure of 2.94 (N). A pressing force of the guide pressing spring 7 urging the lower transfer guide 3 is set to a total pressure (spring pressure) of 4.31 (N), and an actual pressure Pg (a pressure actually applied to the transfer material) is 2.25 (N).

As described above, the total pressure means a pressing force that the guide pressing spring 7 exerts when the lower transfer guide 3 is positioned at the rest location, and the actual pressure means a pressing force that the lower transfer guide 3 actually exerts at its contact point between transfer guide 3 and the recording material Q due to the pressing force of the guide pressing spring 7. In this embodiment, a connection position between the lower transfer guide 3 and the guide pressing spring 7 is set to be closer to the rotation center of the lower transfer guide 3 than the contact point between the lower transfer guide 3 and the recording material Q, thereby causing the actual pressure Pg to set to be less than the total pressure, as examples of specific numeric data mentioned above. Moreover, the invention defines the scope of claims using the actual pressure (N), irrespective of the total pressure of the guide pressing spring 7, the positional relationship between the lower transfer guide 3 and the guide pressing spring 7 or the like. When a length of a contact region between the photosensitive member drum 1 and the transfer roller 5 with respect to a direction perpendicular to the recording material conveying direction is designated by 1 (mm), the line pressure is represented by an expression of "the above-mentioned actual pressure/1".

Based on a positional relationship among the registration roller pair 2, the upper transfer guide 4, and the transfer portion, a position of the upper transfer guide 4 leads to definition of a point where a tip of the transfer material Q runs into the transfer portion. But, after the transfer material Q runs along the lower transfer guide 3 located on a side of the photosensitive member drum 1 with respect to the tangent line R. Accordingly, a positional relationship between the lower transfer guide 3 and the transfer portion causes an angle of the transfer material Q to be defined. When the recording material Q is conveyed along the lower transfer guide 3, a rear side surface opposite to a toner-transferred-side surface of the recording material Q contacts to the lower transfer guide 3 at a predetermined region (second contact region). A top of the lower transfer guide 3 is positioned on a side of the photosensitive member drum 1 with respect to the tangent line R at the nip portion. The angle contained between the tangent line R at the nip portion and the recording material Q is determined so as not to give rise of the pre-transferring phenomenon.

When the top of the lower transfer guide 3 is thus located on a side of the photosensitive member drum 1 with respect to the tangent line R at the nip portion, the lower transfer guide 3 is subjected to a downward pressing force from the recording material Q because the recording material Q is to take a stance along the tangent line R. This downward pressing force becomes greater as the lower transfer guide 3 is located closer to the photosensitive member drum 1.

Further, the force of the transfer material Q pressing the lower transfer guide 8 becomes greater as the transfer material Q becomes higher in rigidity. Therefore, if the pressing force of the transfer rollers 5 due to the roller pressing spring 6, a position of the top of the lower transfer guide 3, and the pressing force due to the guide pressing spring 7 are unsuitable, the pressing force of the transfer roller 5 may unfavorably yield to the rigidity of the transfer material Q, thereby provides no nip between the photosensitive member drum 1 and the transfer roller 5, which results in the failure of transfer due to the poor transfer nip.

In this embodiment, the pressing force of the transfer roller is determined to be so low as not to have an influence on the life of the photosensitive member drum 1, and further the rest position of the lower transfer guide 3 is located on a side of the photosensitive member drum 1 so as not give rise the pre-transfer phenomenon. Then, when the transfer material Q comprises a thin paper having a basic weight of 64 g/m$^2$ or 80 g/m$^2$, or the like, which is frequently used, optimizing the guide pressing spring 7 for the lower transfer guide 3 causes the lower transfer guide 3 to be substantially immovable to carry out the conveyance without changing the conveying route. On the other hand, when conveying a high rigid paper, such as a heavy paper of 128 g/m$^2$ in basic weight, or an OHP etc., the rigidity of the transfer material Q causes the lower transfer guide 3 to be pressed and hence retracted toward the tangent line R at the nip portion, thereby reducing the pressing force by the transfer roller 5, which ensures the transfer nip. On this occasion, the above-mentioned paper having a basic weight of 64 g/m$^2$ is the least in basic weight out of the papers which are capable of being image-formed by the image forming apparatus according to this embodiment, whereas the above-mentioned paper having a basic weight of 128 g/m$^2$ is the greatest in basic weight out of the papers which are capable of being image-formed by the image forming apparatus according to this embodiment.

The requirements to realize the above-mentioned functions are described below.

First, the following equations (1) and (2) are general deflection equations for an elastic member, where v designates a displacement; θ, an displacement angle; P, a force; a, a length of a beam; E, Young's module; and I, a second moment of area.

$$v=Pa^3/(3EI) \quad (1)$$

$$\theta=Pa^2/(2EI) \quad (2)$$

Solving the equation (1) for P leads to the following equation (3).

$$P=3vEI/a^3 \quad (3)$$

In FIG. 2, respective symbols are defined as follows:

Ptr(N): a pressing force of the transfer roller pressing the photosensitive member drum 1, a(m): a width of the nip portion between the photosensitive member drum 1 and the transfer roller 5 in the recording material conveying direction (shown as an arrow B direction)

R: a tangent line of the photosensitive member drum 1 at a center of the nip portion between the photosensitive member drum 1 and the transfer roller 5 in the recording material conveying direction, v(m): a vertical distance from a recording material conveying direction-wise downstream side end of the nip portion to a straight line (an excursion of the recording material Q when it is not deflected) connecting between a recording material Q conveying direction-wise upstream side end of the nip portion between the photosensitive member drum 1 and the transfer roller 5, and a recording material conveying direction-wise center of a contact region between the lower transfer guide 3 and the conveyed recording material Q, θ: an angle contained between the tangent line R at the nip portion and the recording material Q, P(N): a force of the recording material Q pressing the transfer nip, Iα(m$^4$): a second moment of cross-section of the recording material as a heavy paper (e.g. a sheet width of 297 mm or more, a basic weight of 128 gcm), which is the greatest in basic weight, out of the recording materials which are capable of being image-formed, Eα(N/m$^2$): Young's modulus of the above-mentioned heavy paper, Iβ(m$^4$): a second moment of cross-section of the recording material, as a thin paper (e.g. a sheet width of 297 mm or more, a basic weight of 64 gcm), which is the least in basic weight, out of the recording materials which are capable of being image-formed, $v_1$(m): a vertical distance from a recording material conveying direction-wise center of the second contact region to the tangent line R at the nip portion in a state where the recording material Q and the lower transfer guide 3 contact each other, and $a_1$(m): a distance between the nip portion and a recording material conveying direction-wise center of the second contact region on the tangent line R.

On this occasion, a force $P_1$a(N)of the recording material Q pressing a top of the lower transfer guide 3, in which the recording material Q is the greatest in basic weight and the longest in a direction perpendicular to the recording material conveying direction out of the recording materials which are capable of being image-formed by the image forming apparatus, and a force $P_I\beta(N)$ of the recording material Q pressing a top of the lower transfer guide 3, in which the recording material Q is the least in basic weight and the longest in a direction perpendicular to the recording material conveying direction, out of the recording materials which are capable of being image-formed by the image forming apparatus, are represented below, by the use of the above-mentioned equation (3).

$$P_1\alpha(N)=3v1E\alpha I\alpha/a1^3 \quad (4)$$

$$P_1\beta(N)=3v1E\beta I\beta/a1^3 \quad (5)$$

As shown in FIG. 3, the $P_1\alpha$ value obtained by the use of the equation (4) is 2.99 (N), and the $P_1\beta$ value obtained by the use of the equation (5) is 0.14 (N).

Here, when an actual pressure of the guide pressing spring 7 pressing the lower transfer guide 3 is designated by Pg, the actual pressure Pg is set to within a range of $P_1\beta<Pg<P_1\alpha$ (6) in this embodiment, and specifically to be 2.25 (N).

According to the above-mentioned construction, in the recording material Q which is the least in basic weight and the longest in a direction perpendicular to the recording material conveying direction, out of the recording materials which are capable of being image-formed, the Pg value is over the $P_1\beta$ value, thereby causing the lower transfer guide 8 to be moved, which enables the recording material Q of a thin paper to proceed along the photosensitive member drum 1 to prevent the pre-transfer phenomenon. The photosensitive member drum 1 rotates in the arrow A direction. Further, in the recording material Q which is the greatest in basic weight and the longest in a direction perpendicular to the recording material conveying direction, the $P_1\alpha$ value is over the Pg value, thereby causing the lower transfer guide 3 to be moved (retracted), which reduces the angle θ contained by the tangent line R at the nip portion and the recording material Q. Therefore, a pressure of the recording material Q going down the transfer roller 5, thereby preventing the failure of the transfer due to the poor transfer. That is, it is possible to optimize the pressing force of the guide pressing spring 7, and hence to usually carry out the favorable transfer.

Moreover, the above-mentioned preferable embodiment is described using examples relating to the recording material Q having basic weights of 128 g/m$^2$ as a heavy paper, and of 64 g/m$^2$ as a thin paper; however, it is possible to achieve the same effect by setting other passable recording materials as the upper limit one and the lower limit one according to the specification of the image forming apparatus and hence obtain the optimum guide pressure.

Further, in this embodiment, the recording material Q which is the least in basic and the longest in a direction perpendicular to the recording material conveying direction, weight out of the recording material which are capable of being image-formed, or the recording material Q which is the greatest in basic weight and the longest in a direction perpendicular to the recording material conveying direction out of the recording material which is capable of being image-formed is determined according to the specifications described in service manuals and catalogues of the image forming apparatuses.

Second Embodiment

Figure 4:
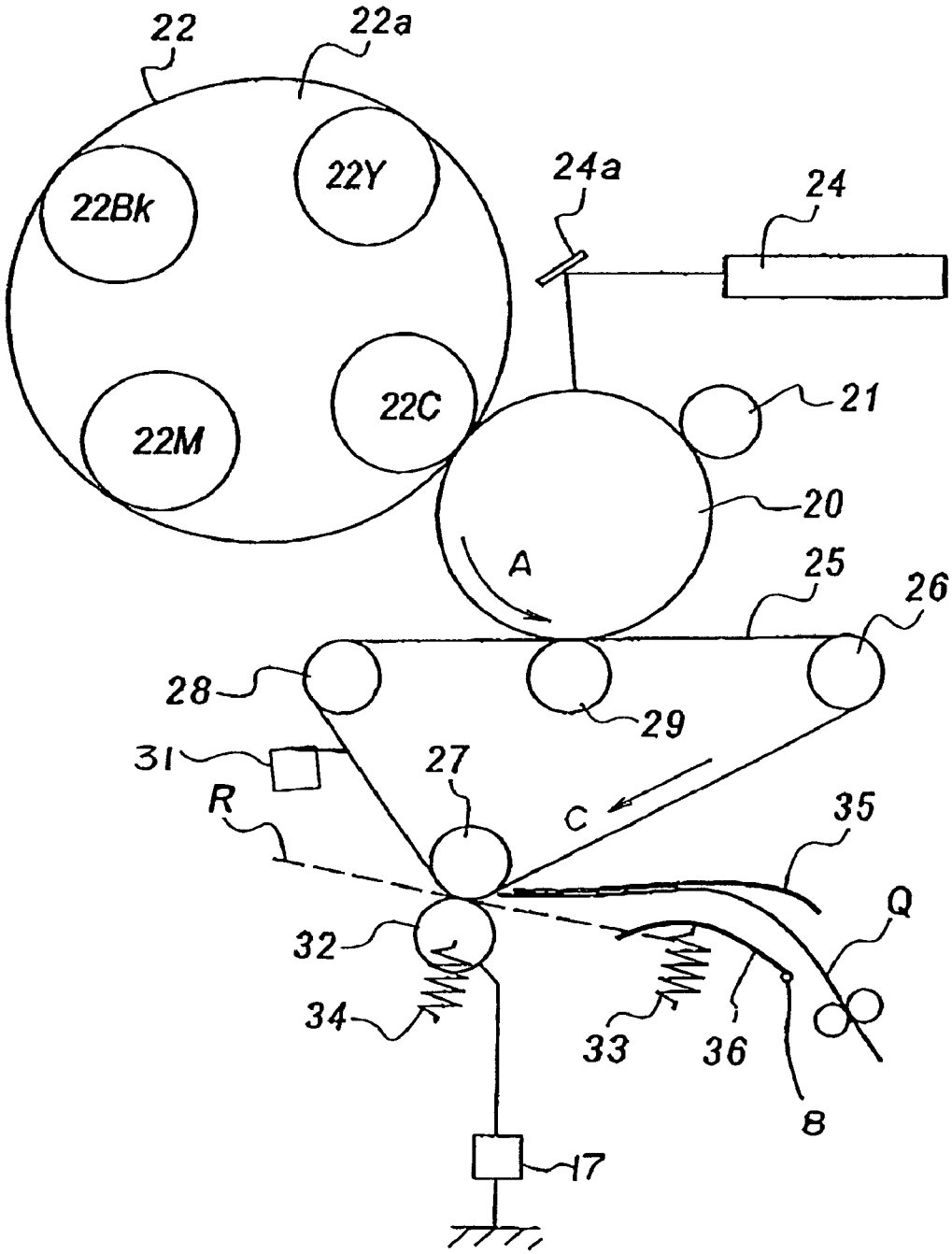
FIG. 4 schematically shows an arrangement of essential parts of an image forming apparatus according to a second embodiment of the invention.
Figure 5:
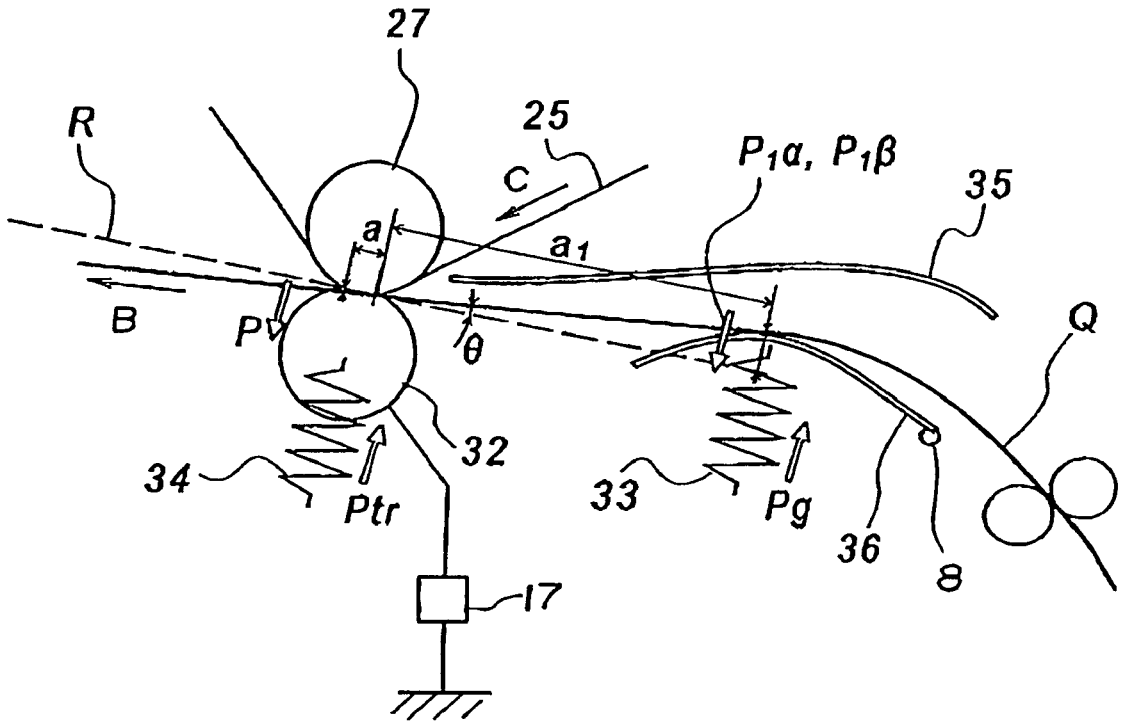
FIG. 5 is an enlarged diagrammatical view which is helpful in explaining a secondary transfer portion and its vicinity.

Referring to FIGS. 4 and 5, there is described an image forming apparatus according to a second embodiment of the invention.

FIG. 4 schematically shows an arrangement of essential parts of an image forming apparatus according to a second embodiment of the invention. FIG. 5 is an enlarged diagrammatical view which is helpful in explaining a secondary transfer portion and its vicinity. In these figures, elements and parts corresponding to those in FIGS. 1 and 3 as the first embodiment are designated by identical reference numerals, description of which is, therefore, omitted.

In the above-mentioned first embodiment, the image forming apparatus is so constructed to directly carry out the transfer from the photosensitive member drum (image bearing member) to the recording material Q, whereas in this second embodiment, it is so constructed to carry out the transfer form the photosensitive member drum (image bearing member) to the recording material through an intermediate transfer belt 1 (image bearing belt).

An image forming apparatus shown in FIG. 4 is a laser beam printer of an electrophotographic type for forming color images, and including an intermediate transfer member (intermediate transfer belt). In this image forming apparatus, a photosensitive member drum 20 rotating in the arrow A direction at a predetermined process speed (e.g. 117 m/sec) is electrically charged in a uniform manner. Then, a laser light is scanned on a surface of the photosensitive member drum 20 from an exposure apparatus through a reflection mirror 24*a*, thereby causing respective color electrostatic latent images to be formed on the surface of the photosensitive member drum 20. These electrostatic latent images are developed as respective color images by sequentially moving a yellow development unit 22Y, a magenta development unit 22M, a cyan development unit 22C, and a black development unit 22Bk disposed around a rotation member 22*a* of a development apparatus 22 to a development position opposed to the photosensitive member drum 20. These respective color toner images are primarily transferred on the intermediate transfer belt 25 rotating in an arrow C direction in a sequential and overlapping manner. The formed color toner images are secondarily transferred in a lump on to the recording material Q in an electrostatic manner by applying a bias from the electric source 17 to a secondary transfer roller 32. The recording material Q undergoing the secondary transfer is heated and pressed by a fixing apparatus (not shown) where the toner image is fixed, and then discharged to the outside, followed by terminating a series of the image forming operations. Moreover, the waste toner remains on the intermediate transfer belt 25 after the secondary transfer is removed by a cleaning operation of a belt cleaning device 31. Then, as shown in FIG. 5, the recording material Q is transferred in the arrow B direction by intermediate transfer belt 25 and the secondary transfer roller 32

Next, a secondary transfer portion according to this embodiment of the invention will now be described in detail.

The intermediate transfer belt 25 is engaged with a driving roller 26, a secondary transfer opposed roller 27, and a tension roller 28, respectively; accordingly, rotatably driving the driving roller 26 causes the intermediate transfer belt 25 to be rotated. The driving roller 26 comprises a core shaft, and a rubber material disposed around the core shaft. Further, the intermediate transfer belt 25 includes a single layer seamless belt having a thickness of 75 μm, a circumferential length of 1860 mm, and a longitudinal length of 310 mm.

This belt is made of resin, specifically polyimide which is adjusted in resistance by carbon dispersion. In this embodiment, the intermediate transfer belt 25 is $10^9$ Ωcm in volume resistivity ρv when a voltage of 100V is applied.

The secondary transfer roller 32 is pressurecontacted to the intermediate transfer belt 25 at a predetermined region (first contact region) by a roller pressing spring 34 (transfer member urging means). A pressure of the transfer roller pressing the intermediate transfer belt 25 has less effect on scares and scratches on the intermediate transfer belt 25 compared with the case of the photosensitive member drum 20; however, the pressing of the transfer roller contributes scares and scratches on the intermediate transfer belt 25, as is the case with the photosensitive member drum 20. Therefore, a pressure of the roller pressing spring 34 pressing the secondary transfer roller 32 is set to be not $18.62\times10^{-3}$ N/mm or less, and $2.47\times10^{-3}$ N/mm or more.

At a location upstream side of the nip portion between the secondary transfer roller 32 and the secondary transfer opposed roller 27, an upper transfer guide 35 and a lower transfer guide 36 (guide member) are disposed. The lower secondary guide 36 is movable so as to separate from or come close to the upper transfer guide 35, thereby making it possible to vary an angle of the recording material Q entering into the nip portion between the intermediate transfer belt 25 and the secondary transfer roller 32. Further, the lower transfer guide 36 is urged to a constant position by a guide pressing spring 33 (guide member urging means). An effect of the angle of the recording material entering into the nip portion through the upper transfer guide 35 and the lower transfer guide 36, when conveying and transferring the transfer material Q is substantially identical with that of the first embodiment.

Symbols and reference numerals shown in FIG. 5 are identical with those of the first embodiment. In this embodiment also, the actual pressure Pg (N) of the guide pressing spring 33 pressing the lower transfer guide 36 is represented by the use of the following equations.

$$P_1\beta<Pg<P_1\alpha$$

where $P_1\alpha=3v1E\alpha I\alpha/a1^3$, $$P_162=3v1E\beta I\beta/a1^3$$

CROSS-REFERENCE TO RELATED APPLICATION

This application claims the benefit of priority from the prior Japanese Patent Application No. 2004-255272 filed on Sep. 2, 2004 the entire contents of which are incorporated by reference herein.

What is claimed is:

1. An image forming apparatus comprising:

an image bearing drum that bears a toner image;

a transfer member that contacts said image bearing drum at a first contact region, and electrostatically transfers said toner image on to a recording material being conveyed;

a transfer member urging unit that urges said transfer member to said image bearing drum at a line pressure of $18.62\times10^{-3}$ N/mm or less and $2.47\times10^{-3}$ N/mm or more, said line pressure being taken along a direction perpendicular to a recording material conveying direction;

a guide member that contacts a rear side surface opposite to a toner-transferred-side surface of said recording material, that is movable in a direction substantially perpendicular to a tangent line of said image bearing drum at a recording material conveying direction-wise center of said first contact region and toward said recording material, and that guides said recording material being conveyed toward said first contact region;

a guide member urging unit that urges said guide member toward said recording material contacting said guide member along a moving direction of said guide member, wherein when respective symbols are defined as follows:

$I\alpha(m^4)$: a second moment of cross-section of the recording material which is the greatest in basic weight and the longest in a direction perpendicular to said recording material conveying direction, out of the recording materials which are capable of being image-formed, $E\alpha(N/m^2)$: Young's modulus, $I\beta(m^4)$: a second moment of cross-section of the recording material which is the least in basic weight and the longest in a direction perpendicular to said recording material conveying direction, out of the recording materials which are capable of being image-formed, $E\beta(N/m^2)$: Young's modulus, v1(m): a distance from a recording material conveying direction-wise center of a second contact region to said tangent line of said image bearing drum in a state where said recording material does not contact said guide member, and a1(m): a distance from a foot of a perpendicular line drawn from a recording material conveying direction-wise center of said second contact region drawn to said tangent line of said image bearing drum, to the most upstream side location of said first contact region in said recording material conveying direction, in a state where said recording material does not contact said guide member, P1α(N): a substantially perpendicular component part to said tangent line of said image bearing drum, out of a force of said recording material pressing a recording material conveying direction-wise center of said second contact region, in which the recording material is the greatest in basic weight out of said recording materials which are capable of being image-formed and the longest in a direction perpendicular to said recording material conveying direction, P1β(N): a substantially perpendicular component part to said tangent line of said image bearing drum, out of a force of said recording material pressing a recording material conveying direction-wise center of said second contact region, in which said recording material is the least in basic weight and the longest in a direction perpendicular to said recording material conveying direction out of said recording materials which are capable of being image-formed, and Pg(N): a substantially perpendicular component part to said tangent line of said image bearing drum, out of a pressing force of said guide member urging unit pressing said guide member, $$P1\beta<Pg<P1\alpha$$

where $P1\alpha=3v1E\alpha I\alpha/a1^3$, $$P1\beta=3v1E\beta I\beta/a1^3$$

holds.

2. An image forming apparatus comprising:

an image bearing belt that bears a toner image;

a support roller that contacts a rear side surface opposite to a toner-bearing-side surface of said image bearing belt, and supports said image bearing belt;

a transfer member that contacts said toner-bearing-side surface of said image bearing belt at a first contact region supported by said support roller, and electrostatically transfers said toner image on to a recording material being conveyed;

a transfer member urging unit that urges said transfer member to said image bearing belt at a line pressure of $18.62\times10^{-3}$ N/mm or less and $2.47\times10^{-3}$ N/mm or more, said line pressure being taken along a direction perpendicular to a recording material conveying direction;

a guide member that contacts a rear side surface opposite to a toner-transferred-side surface of said recording material, that is movable in a direction substantially perpendicular to a tangent line of said image bearing belt at a recording material conveying direction-wise center of said first contact region and toward said recording material, and that guides said recording material being conveyed toward said first contact region;

a guide member urging unit that urges said guide member toward said recording material contacting said guide member along a moving direction of said guide member, wherein when respective symbols are defined as follows:

$I\alpha(m^4)$: a second moment of cross-section of the recording material which is the greatest in basic weight and the longest in a direction perpendicular to said recording material conveying direction, out of the recording materials which are capable of being image-formed, $E\alpha(N/m^2)$: Young's modulus, $I\beta(m^4)$: a second moment of cross-section of the recording material which is the least in basic weight and the longest in a direction perpendicular to said recording material conveying direction, out of the recording materials which are capable of being image-formed, $E\beta(N/m^2)$: Young's modulus, v1(m): a distance from a recording material conveying direction-wise center of a second contact region to said tangent line of said image bearing belt in a state where said recording material does not contact said guide member, and a1(m): a distance from a foot of a perpendicular line drawn from a recording material conveying direction-wise center of said second contact region drawn to said tangent line of said image bearing belt, to the most upstream side location of said first contact region in said recording material conveying direction, in a state where said recording material does not contact said guide member, $P1\alpha(N)$: a substantially perpendicular component part to said tangent line of said image bearing belt, out of a force of said recording material pressing a recording material conveying direction-wise center of said second contact region, in which the recording material is the greatest in basic weight and the longest in a direction perpendicular to said recording material conveying direction, out of said recording materials which are capable of being image-formed, $P1\beta(N)$: a substantially perpendicular component part to said tangent line of said image bearing belt, out of a force of said recording material pressing a recording material conveying direction-wise center of said second contact region, in which said recording material is the least in basic weight and the longest in a direction perpendicular to said recording material conveying direction, out of said recording materials which are capable of being image-formed, and Pg(N): a substantially perpendicular component part to said tangent line of said image bearing belt, out of a pressing force of said guide member urging unit pressing said member, $$P1\beta<Pg<P1\alpha$$

where $P1\alpha(N)=3v1E\alpha I\alpha/a1^3$, $$P1\beta(N)=3v1E\beta I\beta/a1^3$$

holds.

* * * * *

UNITED STATES PATENT AND TRADEMARK OFFICE

CERTIFICATE OF CORRECTION

PATENT NO. : 7,383,006 B2
APPLICATION NO. : 11/216005
DATED : June 3, 2008
INVENTOR(S) : Taisuke Matsuura It is certified that error appears in the above-identified patent and that said Letters Patent is hereby corrected as shown below:

COLUMN 2:
Line 18, "No. 9-127804)" should read -- No. 9-127804). --.

COLUMN 9:
Line 43, "provides" should read -- providing --.

COLUMN 10:
Line 25, "tion)" should read -- tion), --.
Line 64, "$P_1$a(N)of" should read -- $P_1\alpha$(N) of --.

COLUMN 12:
Line 19, "form" should read -- from --.
Line 56, "roller 32" should read -- roller 32. --.

COLUMN 13:
Line 5, "pressurecontacted" should read -- pressure-contacted --.
Line 44, "$P_1$62=3v1$E\beta I\beta$/a$1^3$" should read -- $P_1\beta$=3v1$E\beta I\beta$/a$1^3$ --.
Line 58, "on to" should read -- onto --.

COLUMN 14:
Line 3, "direction-wise" should read -- directionwise --.
Line 27, "direction-wise" should read -- directionwise --.
Line 42, "direction-wise" should read -- directionwise --.
Line 51, "direction-wise" should read -- directionwise --.

COLUMN 15:
Line 9, "on to" should read -- onto --.
Line 21, "direction-wise" should read -- directionwise --.

UNITED STATES PATENT AND TRADEMARK OFFICE

CERTIFICATE OF CORRECTION

PATENT NO. : 7,383,006 B2
APPLICATION NO. : 11/216005
DATED : June 3, 2008
INVENTOR(S) : Taisuke Matsuura It is certified that error appears in the above-identified patent and that said Letters Patent is hereby corrected as shown below:

COLUMN 16:

Line 2, “direction-wise” should read -- directionwise --.
Line 16, “direction-wise” should read -- directionwise --.
Line 25, “direction-wise” should read -- directionwise --.

Signed and Sealed this

Eighteenth Day of November, 2008

JON W. DUDAS
*Director of the United States Patent and Trademark Office*